US007156395B1

(12) United States Patent
Rosado-Galarza

(10) Patent No.: US 7,156,395 B1
(45) Date of Patent: Jan. 2, 2007

(54) TABLE GAME

(76) Inventor: Juan Rosado-Galarza, Cond. Jardines Metropolitanos II, 361 Calle Galileo, Apt. 2-1, San Juan, PR (US) 00918

( * ) Notice: Subject to any disclaimer, the term of this patent is extended or adjusted under 35 U.S.C. 154(b) by 0 days.

(21) Appl. No.: 11/375,290

(22) Filed: Mar. 14, 2006

(51) Int. Cl.
*A63F 3/00* (2006.01)

(52) U.S. Cl. ..... 273/284; 273/283; 273/248; 273/258

(58) Field of Classification Search ..... 273/283, 273/284, 287, 239, 248, 249, 258, 263, 266, 273/156, 157 R
See application file for complete search history.

(56) References Cited

U.S. PATENT DOCUMENTS 1,553,611 A * 9/1925 Harrison ..... 273/249
3,436,080 A * 4/1969 Schultz ..... 273/287
3,917,273 A * 11/1975 Blakewood, III ..... 273/261
4,341,386 A * 7/1982 Kleva ..... 273/239
4,415,161 A * 11/1983 Westell ..... 273/285
4,489,946 A * 12/1984 Ortiz Burgos ..... 273/249
4,772,027 A * 9/1988 Martel et al. ..... 273/237
5,295,691 A * 3/1994 Mitsui ..... 273/283
5,607,156 A * 3/1997 Samarasinghe ..... 273/146

OTHER PUBLICATIONS

Sierra® Attractions/Hoyle® Board Games—Mancala—*How the game evolved*—CD—1998—USA.
Are You Game.com/University Games—Mancala Travel Edition—Description—2006—USA.
Are You Game.com/University Games—Mancala—Description—2006—USA.
Cardinal Industries, Inc.; *Instructions*; Deluxe Solid Wood Mancala; 2006; USA.

* cited by examiner

*Primary Examiner*—William M. Pierce
(74) *Attorney, Agent, or Firm*—Hoglund & Pamias PSC; Heath W. Hoglund

(57) ABSTRACT

A table game has a center piece and a plurality of end pieces that removably attach to the center piece. Each player has chips and takes turns depositing the chips in the end pieces around the board. When the last deposit made by a player makes a special color combination with previous deposits in an end piece, the player may continue his or her turn in the opposite direction. This is a round trip. If the player deposits a single chip in his or her end piece at the end of a turn, the player may capture that chip. This is a trap.

10 Claims, 12 Drawing Sheets

TABLE GAME

FIELD OF THE INVENTION

The present invention relates generally to a table game suitable for a wide ages.

BACKGROUND

There are a wide variety of board or table games commercially available and played by children and adults. Just to name a few, these include, Monopoly, Scrabble, Chinese Checkers, Checkers, Backgammon, Sorry!, Othello and Mancala.

While some may see board games merely as a way to pass time, they can also serve as useful educational and developmental tools for young children and can help older adults maintain both their wit and dexterity. They are also useful tools for encouraging social interaction not only among players of the same ages but also among players of different ages.

While there are a large number of table games available, many depend upon logic or luck; few are able to incorporate the exercise of basic mathematical skills in a way that is appealing and fun for young children.

SUMMARY OF THE INVENTION

It is one object of the invention to provide a game suitable for play by a wide range of ages.

It is another object of the invention to provide a game that exercises manual dexterity for its play.

It is another object of the invention to incorporate the exercise of simple mathematical skills into the game in a manner that is appealing to young players.

It is another object of the invention to introduce basic terms and concepts of banking in a manner that is appealing to young players.

According to one aspect of the invention, a player withdraws chips from his or her bank and deposits them in banks around the board. If the last deposit is in a bank having a specific combination, the player may withdraw those chips and continue his or her turn in the opposite direction trying to reach his or her bank. This is a "round trip."

According to another aspect of the invention, when a player ends his or her turn, if he or she has completed a round trip and has brought back a single chip in one or both of his or her banks, the player may capture this chip in his or her pocket. This is a "trap." Together, these terms "round trip" and "trap" provide the name of this game "Trip-n-Trap."

According to one embodiment of the invention, a Trip-n-Trap game is especially suited for teaching children basic concepts of banking as well as for practicing basic logic and mathematical skills. The parts of the game are provided. These include a center piece, end pieces and sets of chips. The center piece has a plurality of exterior side walls configured in the shape of a regular hexagon. The end pieces each have a narrow end that removably attaches to one of the plurality of exterior side walls of the center piece and a wide end opposite the narrow end. Each of the end pieces defines a pocket cavity proximate the narrow end and a pair of bank cavities proximate the wide end. The pocket cavity and the bank cavities are sized to hold a plurality of chips. The sets of chips each have a different color or pattern so that each of the sets of chips are visually distinguishable from the other sets of chips. Each set of chips includes five and are numbered one through five. Each end piece has a different color that matches the color of one set of chips. Each player will have an end piece with a set of chips having the matching color.

According to further aspects of the invention, the end pieces have a first and a second pair of side walls. The first pair of side walls connect with the narrow end at an angle. The pocket cavity is defined between the first pair of side walls and is substantially triangular in shape. The second pair of side walls join the first pair of side walls. The second pair of side walls are substantially parallel. The pair of bank cavities have a substantially rectangular shape are positioned between the second pair of side walls. The near end is covered with Velcro for removably attaching the end piece to the center piece.

According to further aspects of the invention, play is begun by attaching one end piece to the center piece for each player. One set of chips is assigned to each player. These are placed by each player in the bank cavities of one of the end pieces of the same color. The players then take turns withdrawing chips from the bank cavities of his or her assigned end piece and depositing them one by one in other contiguous bank cavities around the board until the withdrawn chips are exhausted. When the last chip so deposited by a player is in a bank cavity has at least one chip belonging to the player's color making the deposit and at least one chip belonging to another player's color, that player taking the turn may continuing the turn by withdrawing all of the chips from the bank cavity in which the last deposit was made. These withdrawn chips are then deposited one by one in other adjacent bank cavities in a direction opposite the previous deposits. This is repeated until the last chip deposited is not in a bank cavity having at least one chip belonging to the player's color making the deposit and at least one chip belonging to another player's color. At the end of each player's turn, any chips that were brought back deposited and remain alone in the bank cavities of the end piece belonging to the player making the turn are moved as earnings into the pocket cavity of the end piece belonging to the player making the turn.

DETAILED DESCRIPTION

Trip-n-Trap is a table game that uses capital investment terminology like "deposits, withdrawals, coins, banks and earnings." It is easy to play and can be enjoyed by players of almost any ages. In the complete version of play, it exercises logic, visual memory and basic math skills. Alternatively, a simpler version of play, avoids the need to add the value of chips at the end of play. The game uses chips and a board that are now described.

Chips

The game uses six sets of five rounded chips. Each set has a different color to match with the same color end piece. The five chips in each set are numbered with numerical values from one through five printed on their faces. These are called coins. For example, five red coins will be numbered one through five. The other color sets (blue, yellow, etc.) will be similarly numbered one through five.

In an alternative configuration, the numerical value assigned to a piece can be based upon color. For example, all red pieces might have a value of one, all blue pieces might have a value of two, and so on.

The Board

The game will be played on an innovative board that has a clearly defined form or appearance, but varies with the number of players playing. Although the term "board" is used, it is not in the strict sense of a flat piece of wood or a flat surface for play. Rather the board is a three-dimensional assembly that serves the same purpose as more traditional "boards" used in other games.

The board must be assembled with independent parts. Specifically, the board consists of a center piece and a number of board ends or player fields that attach to the center piece. The player fields are identical, except that they have different colors. The number of players will determine the number of player fields that are attached to the center piece. One player field is used for each player.

Figure 1A:
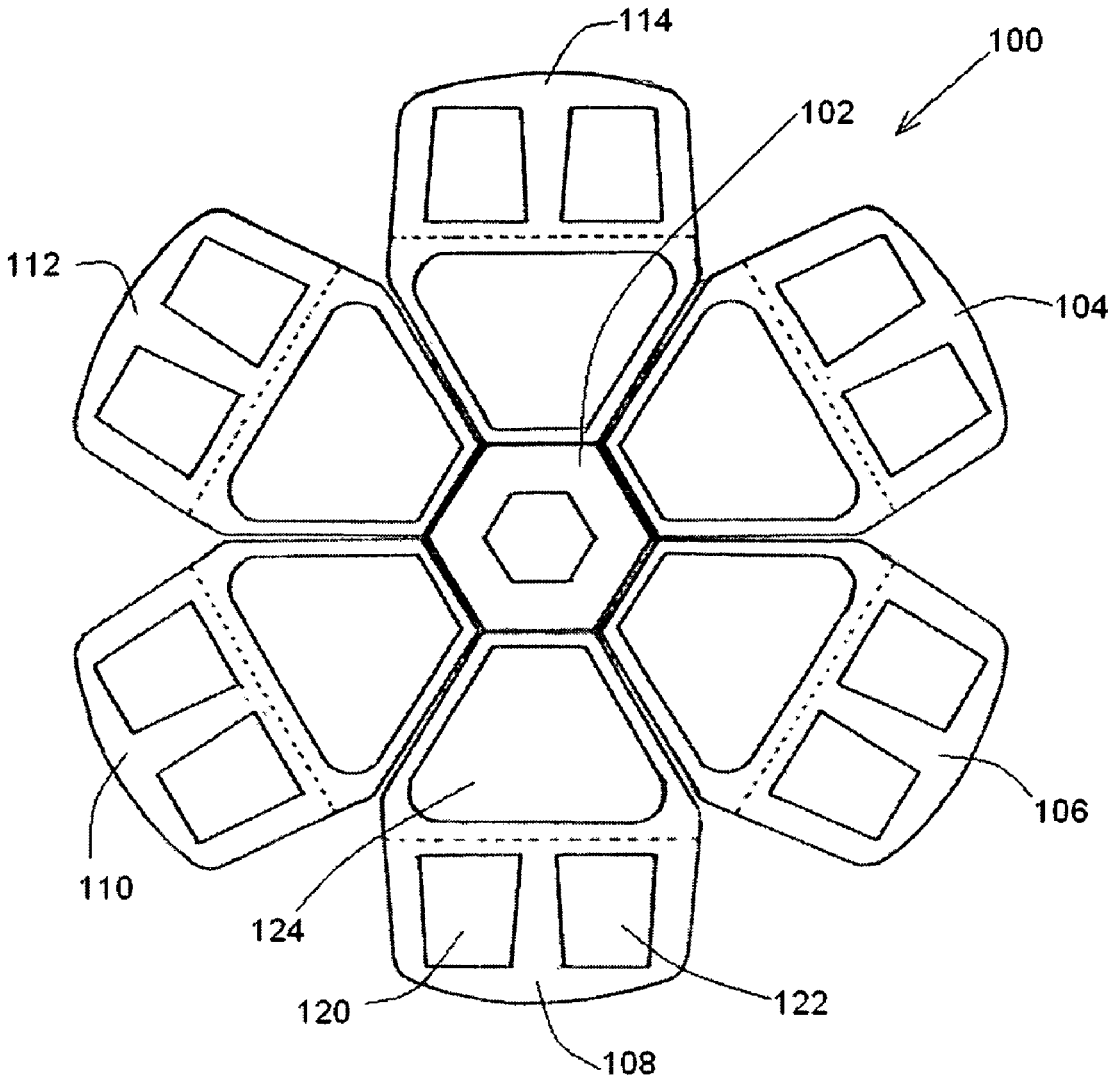
FIG. 1A is a plan view of a Trip-n-Trap game configured for six players.

A complete board 100 is shown in FIG. 1A. It consists of the hexagonal center piece 102. The side walls of the center piece 102 are covered with Velcro. It also has six player fields 104, 106, 108, 110, 112 and 114. These are identical in shape. The narrow, inner wall of the player fields that abut the center piece 102 is also covered with Velcro so that they each attach to the center piece 102.

Figure 1B:
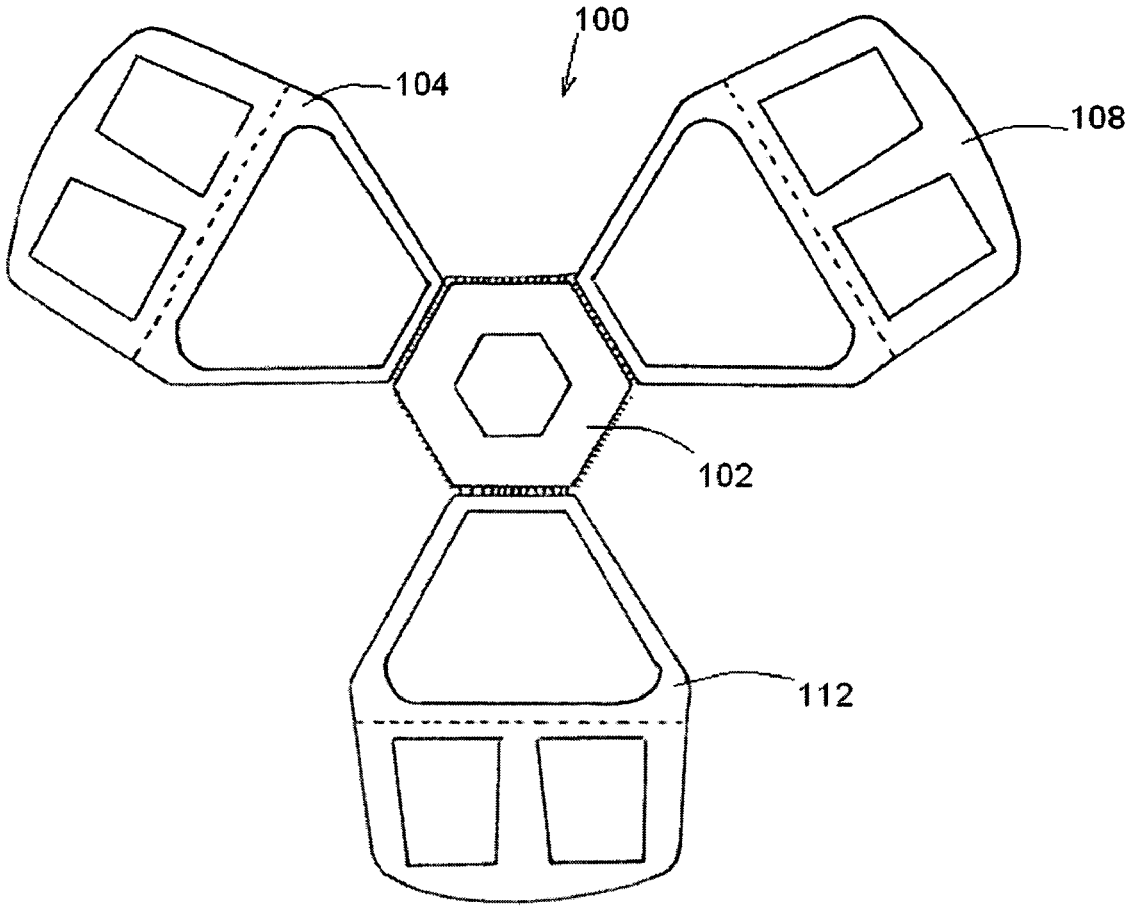
FIG. 1B is a plan view of a Trip-n-Trap game configured for three players.

Although shown in FIG. 1A with all six player fields, fewer players may participate and the number of player fields must be reduced accordingly. With three persons, player fields 104, 108 and 112 can be used so that the board has the appearance of the letter "Y." This is shown in FIG. 1B.

Figure 1C:
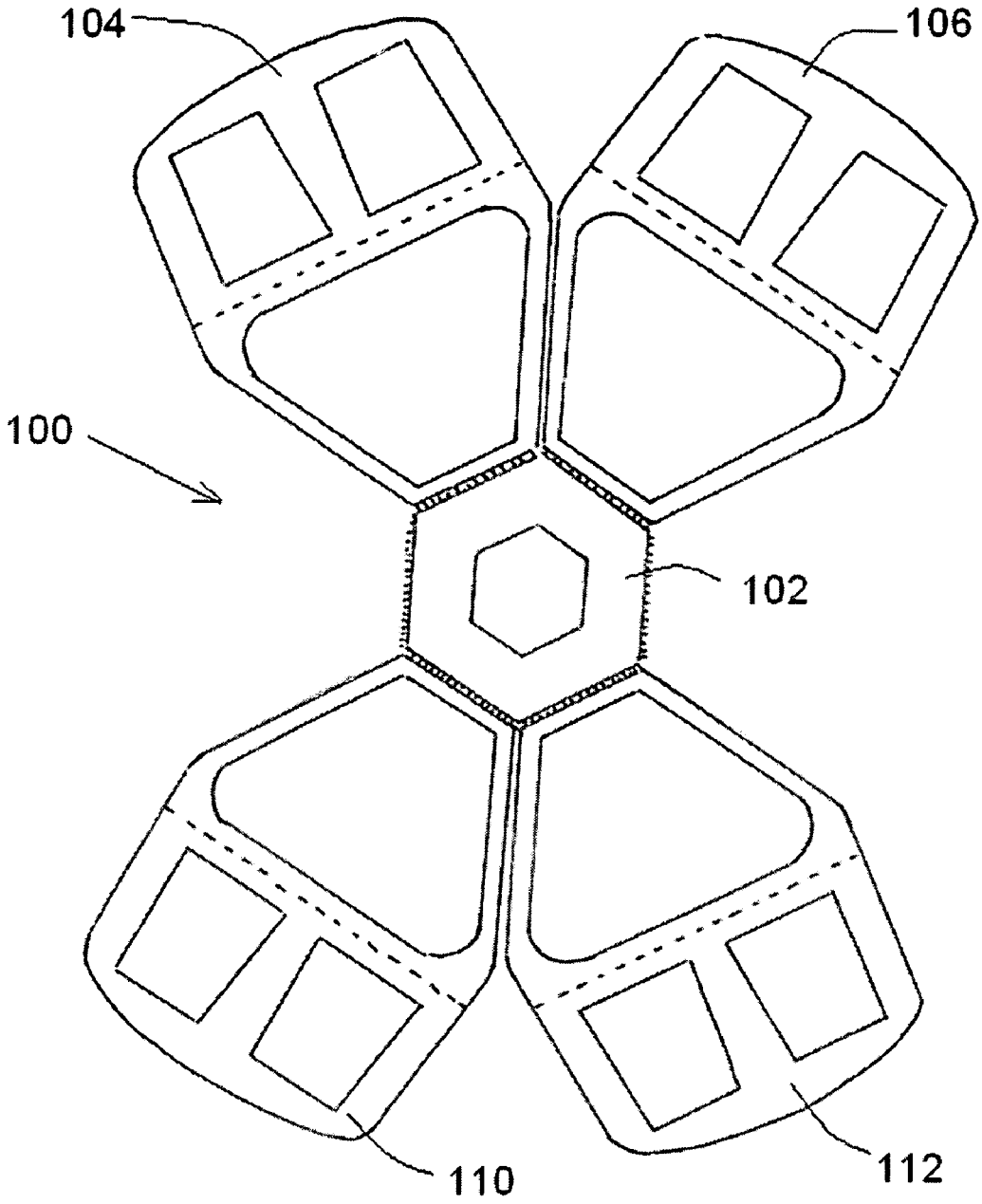
FIG. 1C is a plan view of a Trip-n-Trap game configured for four players.

With four persons, player fields 104, 106, 110 and 112 can be used so that the board has the appearance of the letter "X." This is shown in FIG. 1C.

With five persons, player fields 104, 106, 108, 110 and 112 can be used so that the board has the appearance of a 5-point star. Finally, for six players, the board is configured as shown so that it has the appearance of an asterisk. The board could be expanded to permit a greater number of players. Players may join to play in teams with the partner directly in front of them in a 4–6 players game.

Figure 1D:
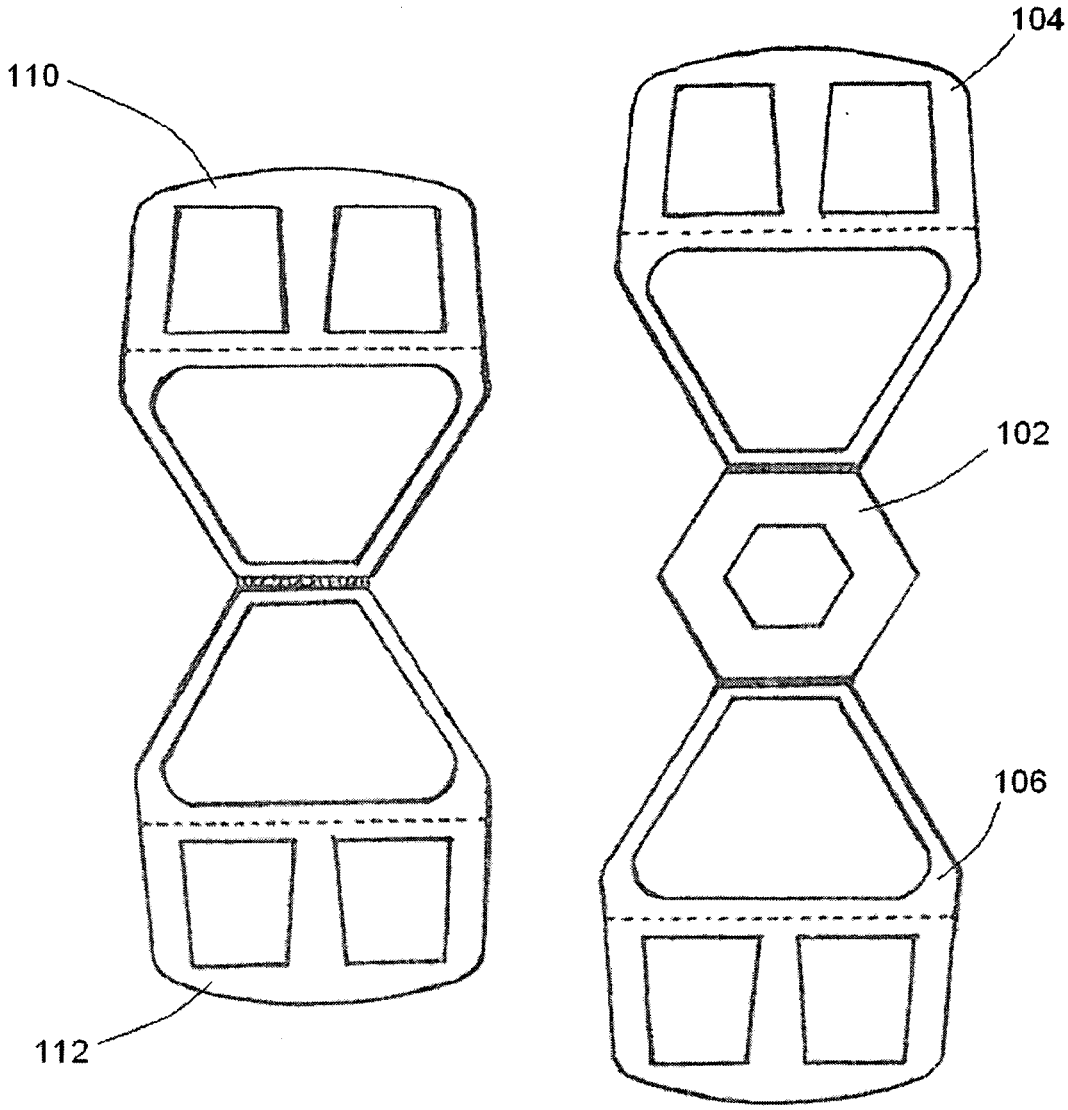
FIG. 1D is a plan view of two Trip-n-Trap games, each configured for two players.

In addition, the pieces from a single board can be divided to provide one two person game and another two or more person game. This configuration is shown in FIG. 1D, where player fields 110 and 112 are directly connected to each other to provide one board. Player fields 104 and 106 are connected to center piece 102 to provide another board for playing two persons or more.

As shown in FIG. 1A, the board ends or player-fields used to assemble this original board are identical in shape. They are an interesting 3D solid playing piece having a substantially triangular inner body portion. Player field 108 consists of two (2) receptacles (or "banks") 120 and 122 to "withdraw" or to "deposit." Game pieces (or "coins") are moved to and from the banks 120 and 122. The two banks 120 and 122 are aligned one beside the other on the lower side of the player field 108. The player field also consists of a triangular-shaped cavity (or "pocket") 124, directly above them where the "earnings" or captured coins are kept.

Game Play

To play the game, each player will begin his or her turn by moving coins from a bank in his or her field. These coins are deposited in adjacent banks around the board, one by one, until the player exhausts the supply withdrawn from his or her bank. When the last deposit generates a specific combination in the receiving bank, the player may continue the turn by withdrawing all chips from the bank in which his or her last deposit was made and then depositing these, one by one, in the contiguous banks around the board in the opposite direction from which the player previously deposited. This is called a "round trip." The specific combination in a bank that is required to continue on a round trip consists of at least one chip of the players own color and at least one chip of another color. Thus, if the player is red and the last deposited coin makes a bunch in the bank that contains two red chips and three green, the player could continue on a round trip. If, however, the handful formed with the last con in the bank contains only green and yellow chips, the player's turn would be finished.

The player may continue making round trips as long as his or her last deposit in a bank makes the specific combination of at least one of his or her color and at least one other color. If the last deposit again generates the specific combination, the player may again continue the turn in the same fashion. If the last deposit does not make the specific combination, the player's turn is over.

One object of the game is to complete a turn and leave a single chip deposited alone in one or both of the player's own banks. In play, this is accomplished with a round trip. In other words, a player withdraws all chips from one of his banks and deposits them, one by one, in contiguous banks around the board. When the player exhausts these chips, if the specific combination is formed in the last bank in which a chip was deposited, the player withdraws the chips from that bank and makes a round trip. If the player has sufficient chips to make a round trip back to his or her own bank, it will be empty and a single chip can be deposited. If the players turn ends without depositing another chip in this bank, the player has trapped the chip. This is called "the round trip and the trap". The player moves the trapped chip from the bank to keep it in the pocket.

Though practicing the game, a player will realize that to capture or trap chips (and to win the game), it is necessary:

(1) to be able to take coins out of the bank at the end of a series of deposits;

(2) to deposit them again one by one in contrary direction to complete a round trip, bringing them back to his or her own banks; and (3) to finish the turn with a single (alone) pieces in the players own banks.

Precisely for these reasons, the game's name is derived from "a round trip-and-the-trap" or "trip-n-trap" for short.

The players will continue taking turns until it is no longer possible for any player to capture another chip. This will become apparent from play. The player that wins will be the player with the highest total value of chips captured and kept in his or her pocket. Each chip has a numeric value. The players add the value of their chips. The player with the highest total wins. If two players have the same score, the winner will be the player with fewer chips. This would mean that the winning player captured more high-value chips.

An alternative method of play does not use the numeric value of the chips. When determining the winner, a simple chip count is taken. The player with the most chips in his or her pocket is the winner. This simplifies the game because a player need not concentrate on strategies of capturing high-value chips, but can implement simpler strategies of simply capturing any chip.

The play of Trip-n-Trap is especially useful for the development and practice of fine and gross dexterities in children and elderly when they pick up and deposit pieces (especially with only one hand). It allows everyone to do simple arithmetic calculations. Everybody can practice the development of strategies in different stages on the game. Moreover, Trip-n-Trap offers in each turn an excellent opportunity to develop and to exercise the visual memory and the dexterity to choose among many different options.

Three-Player Example

Figure 2B:
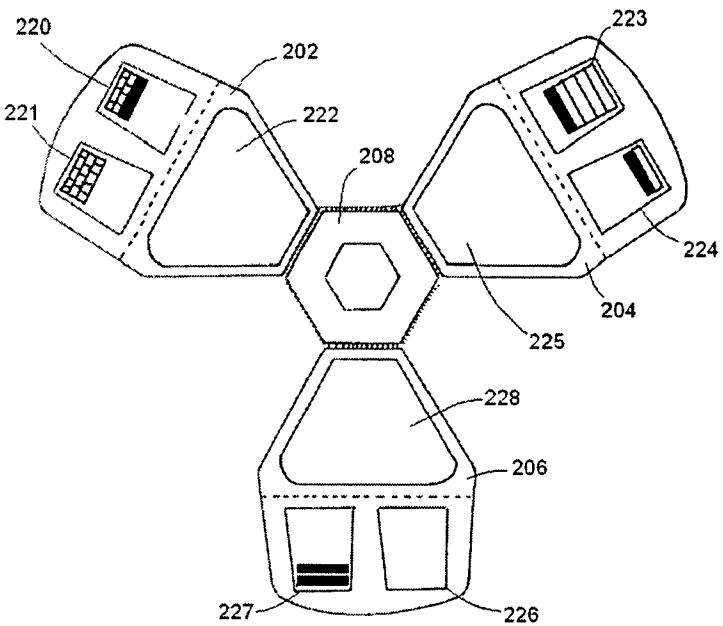
FIG. 2B is a plan view of the Trip-n-Trap game of FIG. 2A, after the first player has begun his or her turn showing the player's possibility to make a "round trip".
Figure 2A:
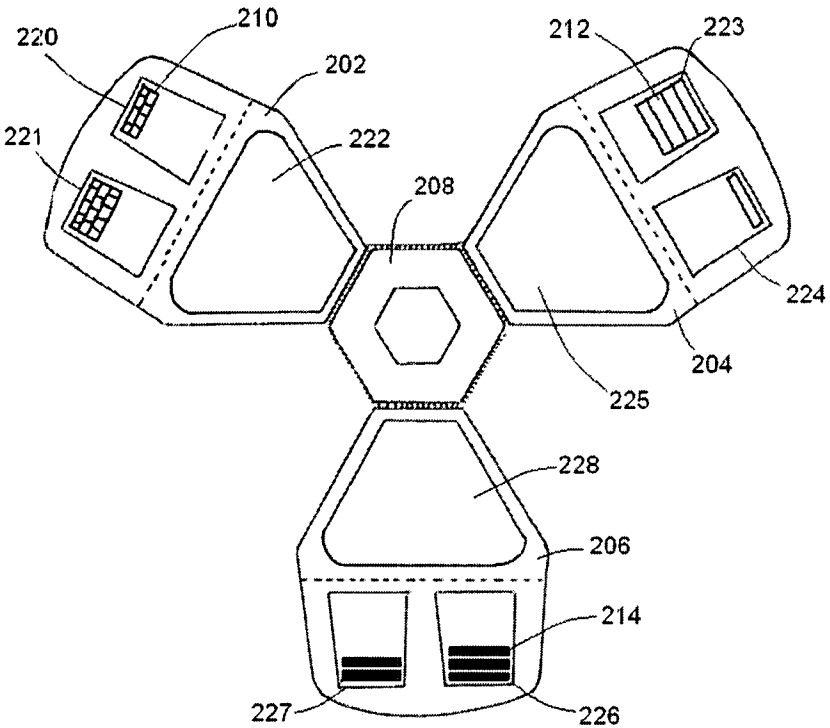
FIG. 2A is a plan view of a Trip-n-Trap game configured for three players, including chips set out for the start of play.

The game is, perhaps, best understood by an actual example of play. Turning to FIG. 2A, the board 200 has been configured for three players. The three player fields 202, 204 and 206 are connected to the hexagonal center joint 208. The three player fields 202, 204 and 206 use every other side of the center joint 208 so that they are evenly spaced. Each of the player fields 202, 204 and 206 contain two banks and one pocket. Specifically, player field 202 has banks 220 and 221 and pocket 222; player field 204 has banks 223 and 224 and pocket 225; and player field 206 has banks 226 and 227 and pocket 228. Each player is given five coins which match with the same color of their player's field. The player at field 202 is given red coins 210 (which are shown with vertical stripes); the player at field 204 is given green coins 212 (which are shown without striping); and the player at field 206 is given blue coins 214 (which are shown solid). The players choose how to distribute their coins between the two banks in their field. The player at field 202 has placed two red coins in bank 220 and three in bank 221; the player at field 204 has placed four green coins in bank 223 and one in bank 224; the player at field 206 has placed two blue coins in bank 227 and three in bank 226.

The players must decide who will begin play. This can be accomplished by voluntary choice among the players or by a competition. In this instance, the player at field 206 will begin play. This player has two choices to make: he or she may select the two coins in the left bank or the three coins in the right bank; and he or she may play clockwise or counter-clockwise. The player selects the three coins in the right bank and plays counter-clockwise. The player removes the three coins from the right bank then places them one per bank into adjacent banks in a counterclockwise direction around the board 200. Thus, one blue coin is placed bank 224 and 223 in player field 204 and one blue coin is placed in bank 220 of player field 202. The result of this play is shown in FIG. 2B.

Figure 2D:
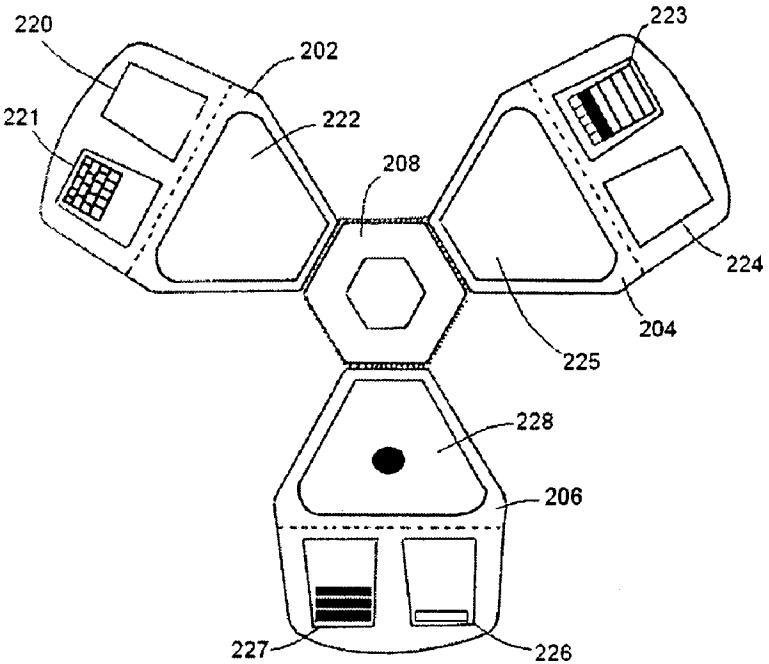
FIG. 2D is a plan view of the Trip-n-Trap game of FIG. 2C, after the second player has completed his or her turn without a "round trip".
Figure 2C:
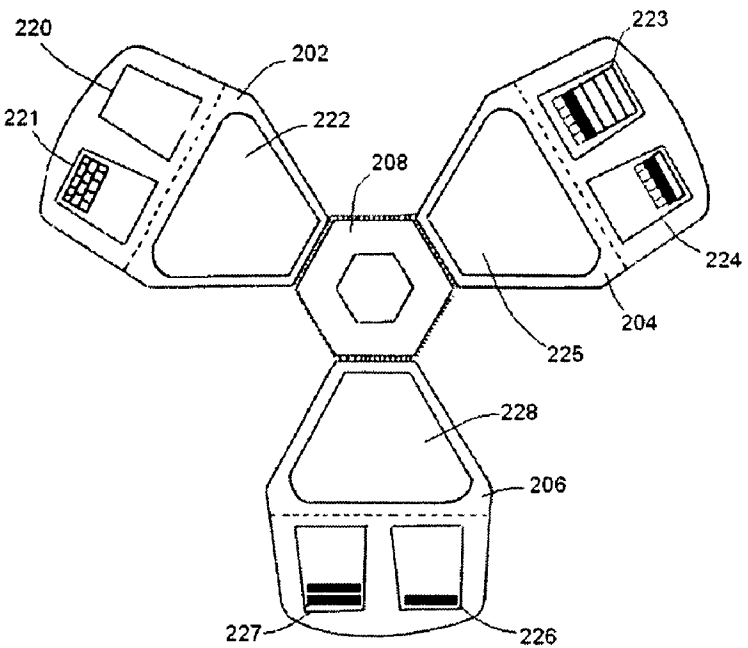
FIG. 2C is a plan view of the Trip-n-Trap game of FIG. 2B, after the first player has completed his or her turn after having a "round trip" and a trapped chip.

The placement of the final coin determines whether this player may continue his turn. The rule is that if the last coin placed in a bank formed a bunch that contains at least one of the player's own color coins with at least one of another player's color coins, he or she may continue his or her turn, otherwise not. Here, the last blue coin is played in bank 220 of player field 202. It has one blue player's color coin and two red. Because this satisfies the rule, the player may continue. He or she does so by removing all of the coins in that bank and playing them in the opposite direction. Thus, the player removes the two red coins and the blue own color coin and places them one by one in a clockwise direction in adjacent banks around the board. The player may choose the order in which these coins are played to obtain the objective. The three possible combinations would be: (1) blue, red and red; (2) red, blue and red; or (3) red, red and blue. The player elects the last option and the result of this play is shown in FIG. 2C.

A player traps a coin when he or she has deposited a coin in either or both of his or her own banks and at the end of his or her turn that coin remains alone in the bank. Here, the player at field 206 has returned a single blue coin to bank 226 in his field 206. This coin is therefore trapped. The player moves this trapped coin to keep it into pocket 228. This completes the players turn.

Play continues with the next player to the right, or in a counterclockwise direction. Thus, the player at field 204, and subsequent turns will take the next turn.

This player also has two choices. He or she may play the coins in bank 223 or bank 224, and he may play in a clockwise or counterclockwise direction. The player elects to play the coins in bank 224 in a clockwise direction. The result of his play is shown in FIG. 2D.

Figure 2F:
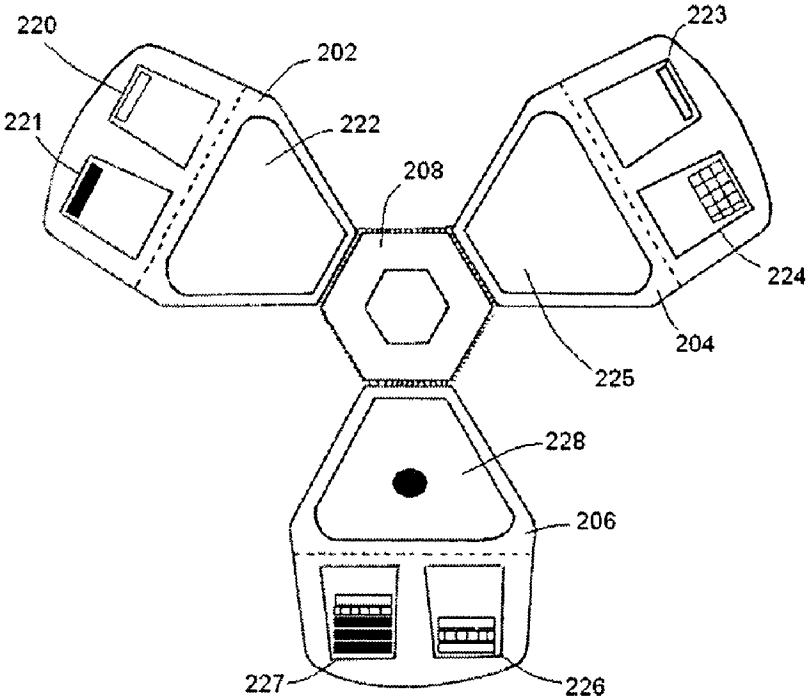
FIG. 2F is a plan view of the Trip-n-Trap game of FIG. 2E, after the third player has completed his or her turn after having a "round trip" and two trapped chips.
Figure 2E:
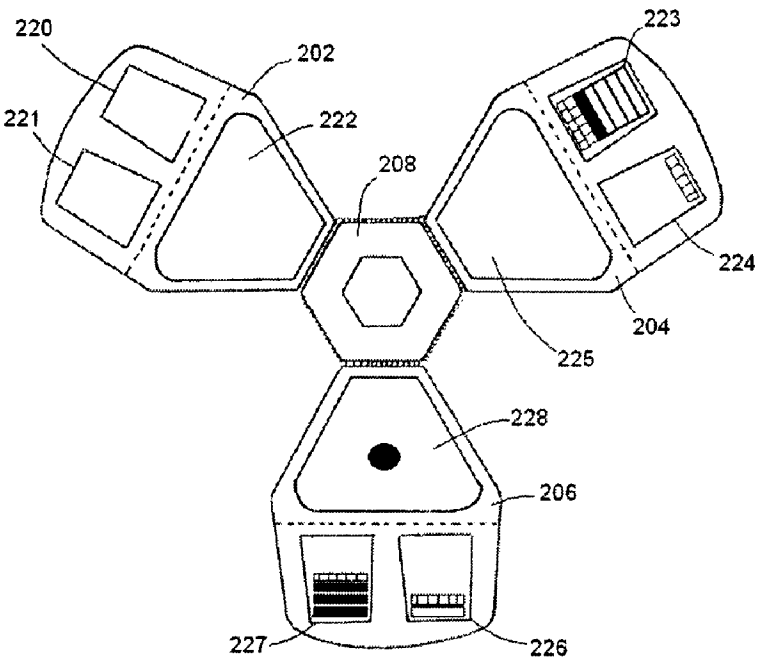
FIG. 2E is a plan view of the Trip-n-Trap game of FIG. 2D, after the third player has begun his or her turn showing the player's possibility to make a "round trip".

As shown, from the first turn, the first player has placed the blue coin trapped at bank 226 in pocket 228. In addition, the second player has placed a green coin in bank 226, a blue coin in bank 227 and a red coin in bank 221. This was a poor choice of playing order by this player because the player could have instead placed the green coin in bank 221 and continued his turn. Instead, the last coin placed is in a bank of only red coins. Consequently, the player's turn ends. The player at field 202 may now begin. Since he or she only has coins in one bank, namely bank 221, there is only one decision to make: whether to play clockwise or counter-clockwise. He or she elects to play counterclockwise, and the last coin he or she places is in bank 223. The result of his turn is shown in FIG. 2E.

Because bank 223 has at least one red coin (player's color) and at least one coin of another color, the player may continue his or her turn by removing the coins in this bank and playing them in a clockwise direction. Since there are two red, one blue and four green coins, there are many possibilities for the order in which these are played. The player elects to use the following sequence: red, green, green, blue, green, green and red. The last coin he or she places is a red coin in bank 224. The result of this play is shown in FIG. 2F.

Figure 2G:
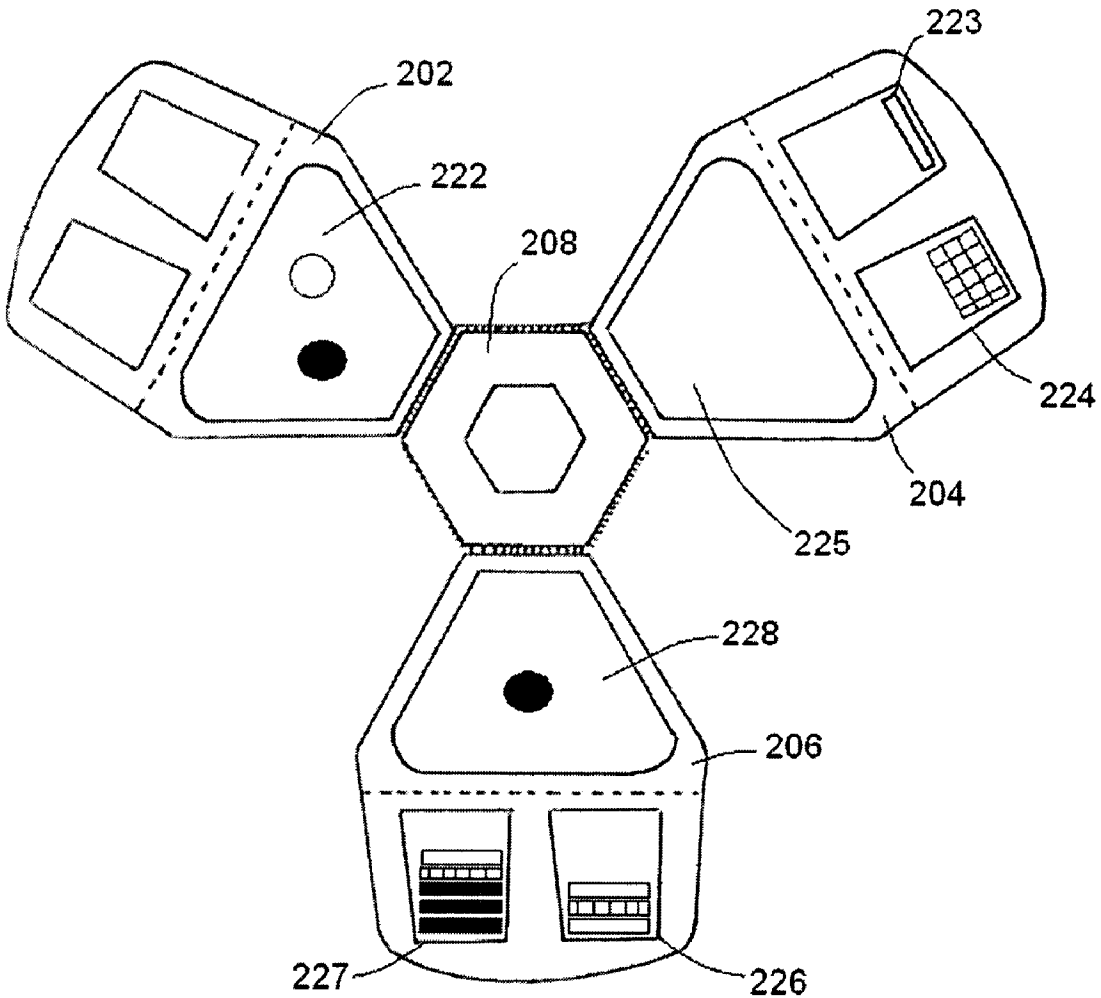
FIG. 2G is a plan view of the Trip-n-Trap game of FIG. 2F, after the third player has moved his or her trapped chips as earnings into their own pocket.

Because the last bank in which a coin is placed does not have any colors other than red, the player's turn ends. At this point, the player has brought back two coins that he or she deposited on a round trip that remain alone in his or her own banks 220 and 221. The player, therefore, has trapped these coins and can keep them by moving them into pocket 222. This is shown in FIG. 2G and completes the first round of turns.

The game then continues with additional rounds of turns. The game ends when it becomes impossible to make further round trips, consequently it is impossible to make captures. This will happen, for example, when the few remaining coins at the end of a play are of the same color, or when the right coins to make a round trip are inaccessible in other section of "contrary playing positions".

Rules

The basic rules of play can be summarized as follows:

RULE 1: The board will be assembled before beginning play with the same number of "player-fields" (or end pieces) as the number of persons that will play the game. Each player may freely distribute his or her five "coins" (or chips) in the two "banks" cavities of his or her field. Then, the players will choose at random which player will play the first playing position. The player at the right side will follow in turn at second playing position and so forth.

RULE 2: The first player and each player thereafter will start his or her turn by "withdrawing" all of the coins from either two banks of his or her field and then "deposit" them one by one in other banks toward adjacent field around the board. The player may choose to make deposits in a clockwise or counterclockwise direction but may not skip any banks as the chips are deposited one by one around the board until the last one is deposited.

RULE 3: If a player does not have any chips in his or her banks, the player must pass the turn. If a player has chips in his or her bank, the player must play in the turn.

RULE 4: Whenever a player completes a deposit toward adjacent fields around the board and the last coin deposited in a bank forms a bunch of coins that contains one or more coins having the same color assigned to the player making the deposit and one or more coins having a color assigned to another player, the player must withdraw all such coins from that bank and repeat the sequence of depositing for these coins in contiguous banks around the board, but must do so in the opposite direction as the just completed deposit, trying to bring back a coin to his or her empty banks. This is a "round trip." The player will repeat round trips until the last coin is deposited to a bank where it does not make the containing the combination one or more coins having the same color assigned to the player making the deposit and one or more coins having a color assigned to another player. Here the turn finishes.

RULE 5: When a player's turn finishes after one or more "round trips," the player will "trap" any single coin that he or she brought back to one or both of his or her own banks if it is placed alone in a previously empty bank. These trapped coins are moved as earnings from the bank to the own field's "pocket".

RULE 6: When the players begin playing the final stage with few coins in a three or more players match, any player can claim the use of the "contrary playing positions", (odd vs. even and even vs. odd) announcing loudly the "vicious circle". This can be claimed at any moment, only when none of the players has more than one coin of own color on play. The players in odds-number playing-positions (i.e., $1^{st}$, $3^{rd}$ and $5^{th}$) must start playing each turn in a clockwise direction from their right bank and the players in the even-number playing positions (i.e., $2^{nd}$, $4^{th}$ and $6^{th}$) must start playing each turn in a counterclockwise direction from their left bank. The purpose of this rule is to split the board in different playing sections forcing the players in odd and even number playing positions to play toward each other and not to run away. It avoids the problem where a player stalks another player and where a player runs away and vice versa, to save his or her own coin and the play continues without end or progress.

RULE 7: The game will finish when it is not possible for any player to make further round trips and consequently no captures are possible, either because there is only one color remaining or because the right coins to make a round trip are inaccessible in another sections of "odd-even contrary playing positions".

RULE 8: The winner will be the player who obtains the highest sum of printed numerical values in the earned coins, collected and saved in their field pocket. When two or more players tie for the highest value of earned coins, the winner will be the player that has the fewest earned coins (and so captured more high-value chips).

ALTERNATIVE RULE 8: In an alternative version of the game referred to as "easy mode," the winner will simply be the player that collects greatest number of coins in his or her pocket without regard to the numerical value of the coins. This makes for an easier game, but reduces the benefit of practicing simple mathematical operations through play of the game.

Center Piece

Figure 3A:
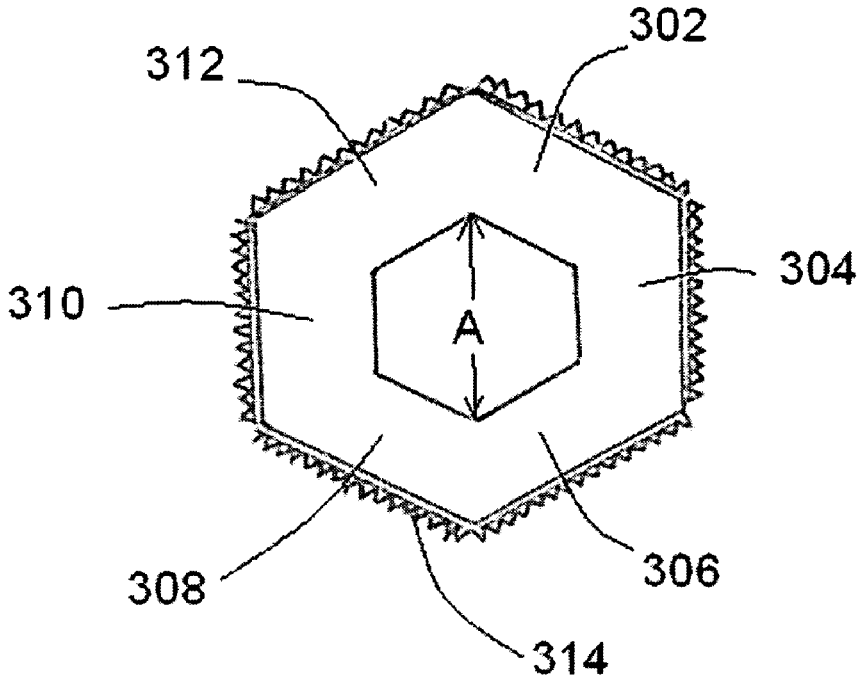
FIG. 3A is a plan view of a center piece of a Trip-n-Trap game.
Figure 3B:
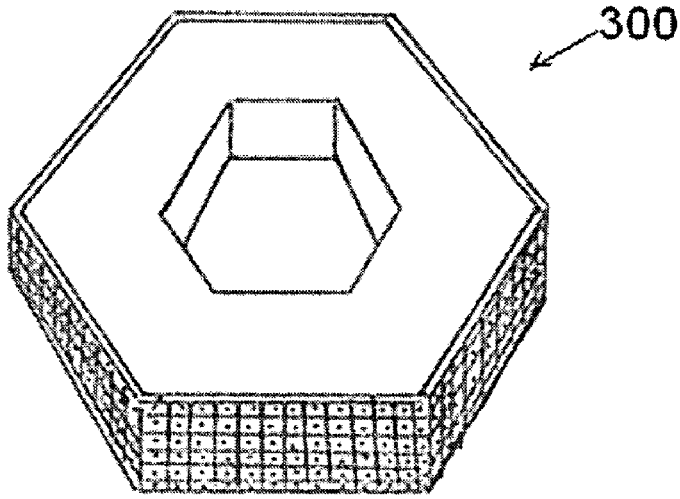
FIG. 3B is a perspective view of the center piece of FIG. 3A.

Turning to FIG. 3A, the center piece 300 used as the center of the board is further described. From the top view, it has a regular hexagonal shape. It has six vertical walls 302, 304, 306, 308, 310 and 312. The outer surface of each wall is covered in Velcro 314. The six vertical walls 302, 304, 306, 308, 310 and 312 define a hollow core. It has a maximum inner dimension A of approximately ¾ of an inch. The maximum outer dimension across the hexagon is approximately 1 and $^{11}/_{16}{}^{th}$ inches. Turning to FIG. 3B, the center piece 300 is shown from an isometric view.

Side or End Pieces

Figure 4A:
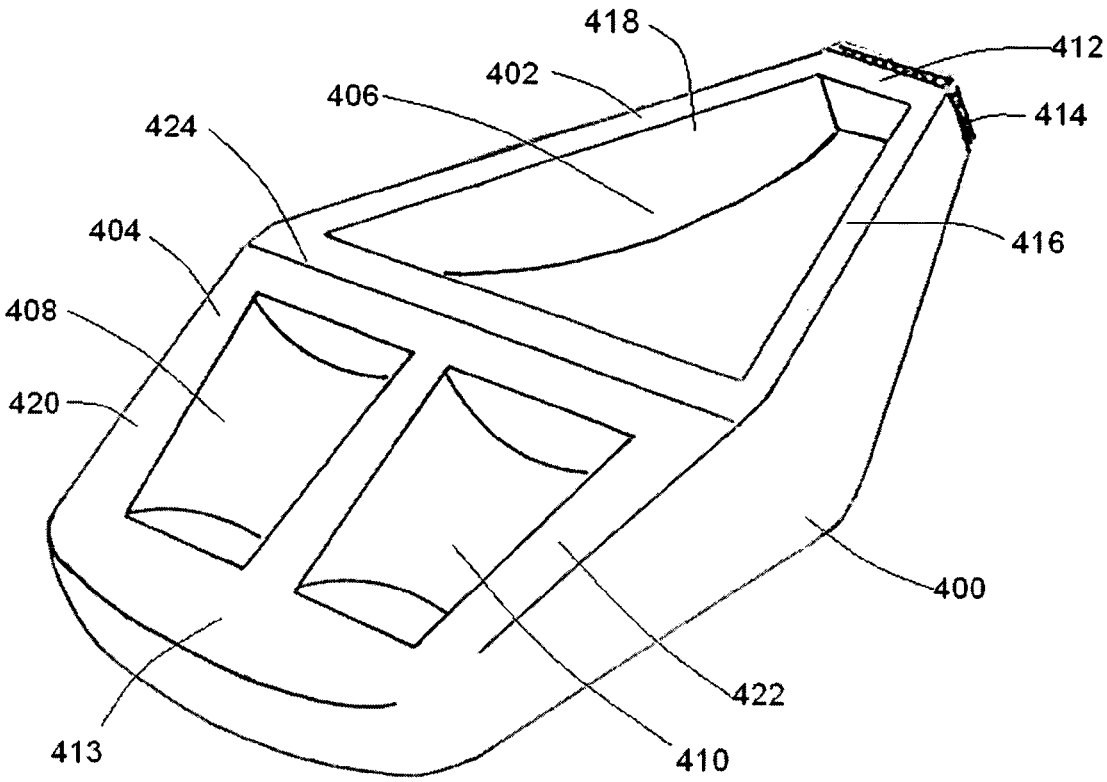
FIG. 4A is a perspective view of an end piece of a Trip-n-Trap game.

Turning to FIG. 4A, an end or side piece 400 of the board is further described. It can be divided into two sections: an inner section 402 and an outer section 404. The inner section 402 is used to define the pocket chamber 406 and to connect to the center piece. The outer section 404 is used to define two bank chambers 408 and 410. The end nearest to the center piece or near end 412 is covered with Velcro 414. This interlocks with one face of the center piece shown in FIG. 3. The near end 412 is simply a short vertical wall. On each end it meets a side wall 416 and 418, which are also vertical. These join the near end 412 at an angle to give the inner section 402 a triangular shape.

The outer section 404 also has a pair of side walls 420 and 422. Side wall 420 joins side wall 418 at an angle. Side wall 422 joins side wall 416 also at an angle. The side walls 420 and 422 incline slightly in the opposite direction as the side walls 416 and 418, however, side walls 420 and 422 are much closer to parallel so that the outer section 404 appears nearly rectangular rather than triangular in shape. The inner section 402 and the outer section 404 are separated by a center wall 424, which is peaked between these two sections. The outer section 404 is bounded by an outer wall 413. It is substantially wider than the narrow near end 412.

Figure 4B:
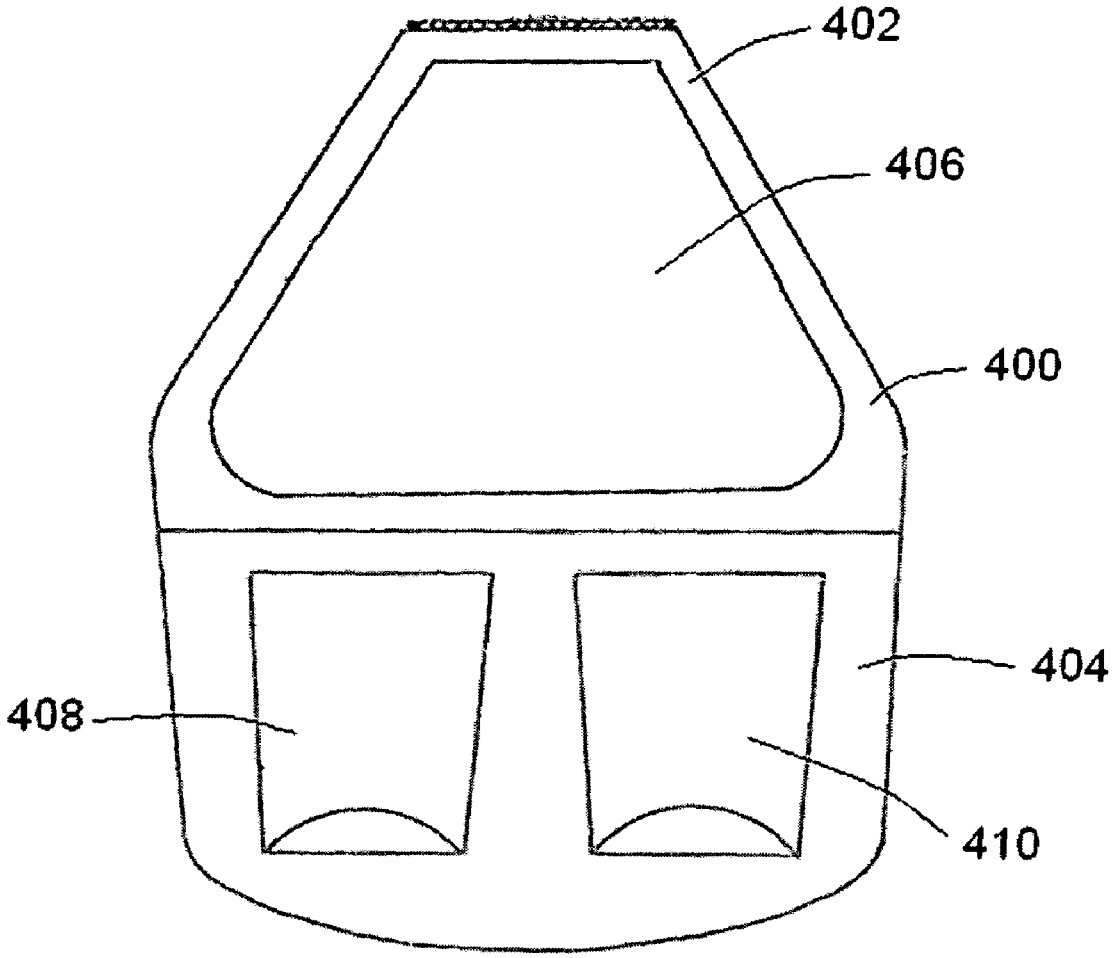
FIG. 4B is a plan view of the end piece of FIG. 4A.

Turning to FIG. 4B, a top view of the end piece 400 is shown. The pocket chamber 406, defined by the inner section 402, has a substantially triangular shape. It is the adequate size to hold earned coins in a play. The two bank chambers 408 and 410 defined in outer section 404 have a substantially rectangular shape. They form a pair of troughs that are also sized to fit at least twelve chips.

Figure 4C:
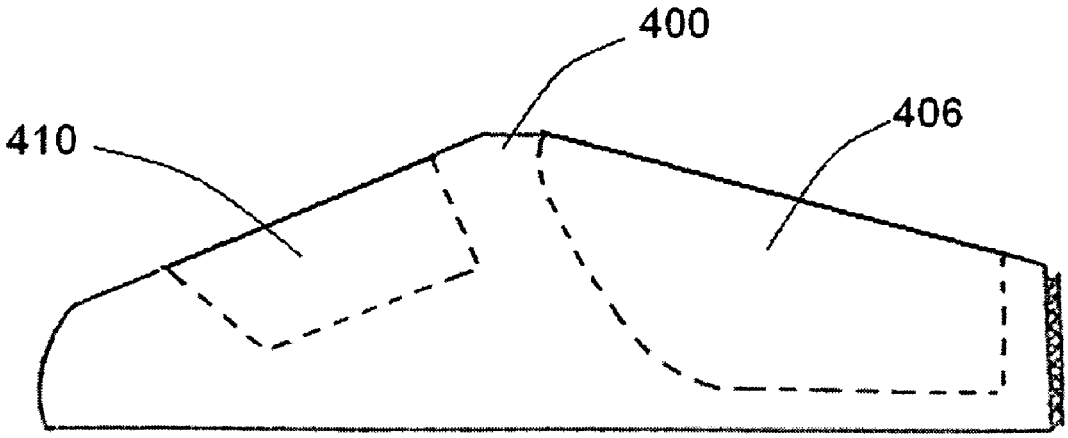
FIG. 4C is a side view of the end piece of FIG. 4A.

Turning to FIG. 4C, a side view of the end piece 400 is shown. A cross section of the pocket chamber 406 is shown with dashed lines. A cross section of the bank chamber 410 is also shown with dashed lines.

Although the board is shown as a three-dimensional combination of a center piece and a number of end pieces, the board could also be made more simply as a flat playing board. It would have the same areas described above on a flat playing surface.

CLAIMS

In the foregoing specification, embodiments of the invention have been described with reference to numerous specific details that may vary from implementation to implementation. Thus, the sole and exclusive indicator of what is the invention, and is intended by the applicants to be the invention, is the set of claims that issue from this application, in the specific form in which such claims issue, including any subsequent correction. Any definitions expressly set forth herein for terms contained in such claims shall govern the meaning of such terms as used in the claims. Hence, no limitation, element, property, feature, advantage or attribute that is not expressly recited in a claim should limit the scope of such claim in any way. The specification and drawings are, accordingly, to be regarded in an illustrative rather than a restrictive sense.

I claim:

1. A table game comprising:

a center piece having a plurality of exterior side walls;

a plurality of end pieces each having a narrow end that removably attaches to one of the plurality of exterior side walls of the center piece and a wide end opposite the narrow end, wherein each of the end pieces define a pocket cavity proximate the narrow end and a pair of bank cavities proximate the wide end, wherein the pocket cavity and the bank cavities are sized to hold a plurality of chips; and a plurality of sets of chips, wherein each of the plurality of sets of chips has a different color or pattern so that each of the plurality of sets of chips are visually distinguishable from the other sets of chips.

2. The table game of claim 1, wherein the center piece comprises:

six vertical walls interconnected to form the exterior side walls and wherein the six vertical walls form a regular hexagon, and wherein the exterior face of the six vertical walls are covered with Velcro.

3. The table game of claim 2, wherein the end pieces each comprise:

a first pair of side walls that connect with the narrow end at an angle, wherein the pocket cavity is defined between the first pair of side walls and is substantially triangular in shape; and a second pair of side walls that join the first pair of side walls, wherein the second pair of side walls are substantially parallel and wherein the pair of bank cavities have a substantially rectangular shape are positioned between the second pair of side walls; and wherein the near end is covered with Velcro for removably attaching the end piece to the center piece.

4. The table game of claim 3, wherein the plurality of sets of chips each comprise a plurality of five chips numbered with a printed numeric value of 1 through 5.

5. The table game of claim 4, further comprising a set of printed rules for play, wherein the printed rules contain instructions directing the players to:

prepare the game for play by attaching one end piece to the center piece for each player and by assigning one set of chips to each player and by each player placing one set of chips in the bank cavities of one of the end pieces, wherein the set of chips has the same color as the end piece;

take turns withdrawing chips from the bank cavities and to deposit them one by one in other adjacent bank cavities around the board until the withdrawn chips are exhausted and, when the last chip so deposited in a bank cavity makes a bunch having at least one chip belonging to the player's color making the deposit and at least one chip belonging to another player's color, to continue the turn by withdrawing all of the chips from the bank cavity in which the last deposit was made and then deposit those chips one by one in other bank cavities in a direction opposite the previous deposits, and to repeat this sequence until the last chip deposited is not in a bank cavity having at least one chip belonging to the player's color making the deposit and at least one chip belonging to another player's color; and at the end of each player's turn, move any chips that were brought back deposited and remain alone in the bank cavities of the end piece belonging to the player making the turn into the pocket cavity of the end piece belonging to the player making the turn.

6. Method of playing a game especially suited for teaching children basic concepts of banking as well as for practicing basic logic and mathematical skills comprising the steps of:

providing a center piece having a plurality of exterior side walls;

providing a plurality of end pieces each having a narrow end that removably attaches to one of the plurality of exterior side walls of the center piece and a wide end opposite the narrow end, wherein each of the end pieces define a pocket cavity proximate the narrow end and a pair of bank cavities proximate the wide end, wherein the pocket cavity and the bank cavities are sized to hold a plurality of chips; and providing a plurality of sets of chips, wherein each of the plurality of sets of chips has a different color or pattern so that each of the plurality of sets of chips are visually distinguishable from the other sets of chips.

7. The method of claim 6, wherein the step of providing the center piece further comprises providing six vertical walls interconnected to form the exterior side walls and wherein the six vertical walls form a regular hexagon, and wherein the exterior face of the six vertical walls are covered with Velcro.

8. The method of claim 7, wherein the step of providing the end pieces further comprise:

providing a first pair of side walls that connect with the narrow end at an angle, wherein the pocket cavity is defined between the first pair of side walls and is substantially triangular in shape; and providing a second pair of side walls that join the first pair of side walls, wherein the second pair of side walls are substantially parallel and wherein the pair of bank cavities have a substantially rectangular shape are positioned between the second pair of side walls; and wherein the near end is covered with Velcro for removably attaching the end piece to the center piece.

9. The method of claim 8, wherein the step of providing the plurality of sets of chips comprises providing sets of chip where each set includes a chip having a printed numeric value of 1, 2, 3, 4 and 5.

10. The method of claim 9 further comprising the steps of:

preparing the game for play by attaching one end piece to the center piece for each player and by assigning one set of chips to each player and by each player placing one set of chips in the bank cavities of one of the end pieces having the same color of the chips;

taking turns withdrawing chips from the bank cavities of the player's own end piece and depositing them one by one in other contiguous bank cavities around the board until the withdrawn chips are exhausted and, when the last chip so deposited in a bank cavity makes with the others coins a handful of at least one chip belonging to the player's color making the deposit and at least one chip belonging to another player's color, continuing the turn by withdrawing all of the chips from the bank cavity in which the last deposit was made and then depositing those chips one by one in other adjacent bank cavities in a direction opposite the previous deposits, and repeating this sequence until the last chip deposited is in a bank cavity forming with the others at least one chip belonging to the player's color making the deposit and at least one chip belonging to another player's color; and at the end of each player's turn, moving any chips that were brought back deposited and remain trapped alone in the bank cavities of the end piece belonging to the player making the turn into the pocket cavity of the end piece belonging to the player making the turn.

* * * * *